US005495829A

United States Patent [19]

Jayaraman et al.

[11] Patent Number: 5,495,829

[45] Date of Patent: Mar. 5, 1996

[54] WATER HEATER WITH THERMOELECTRIC MODULE AND THROUGH-CHAMBER HEAT SINK

[75] Inventors: Viswanath Jayaraman, Brecksville, Ohio; David H. McFadden, Lexington; Scott J. Hynek, Waltham, both of Mass.

[73] Assignee: Consolidated Natural Gas Service Company, Inc., Pittsburgh, Pa.

[21] Appl. No.: 306,128

[22] Filed: Sep. 14, 1994

[51] Int. Cl.[6] ..... F22B 9/12

[52] U.S. Cl. ..... 122/110; 126/110 R; 126/110 E; 126/116 R; 431/236; 431/237

[58] Field of Search ..... 122/110; 126/110 R, 126/110 E, 116 R; 431/236, 237

[56] References Cited

U.S. PATENT DOCUMENTS

| | | | |
|---|---|---|---|
| 2,501,627 | 3/1950 | Findley | 126/116 |
| 2,519,241 | 8/1950 | Findley | 126/116 |
| 3,150,656 | 9/1964 | Huber | 126/110 |
| 3,185,201 | 5/1965 | Herbst et al. | 158/4 |
| 3,759,244 | 9/1973 | Konet | 126/110 R |
| 3,942,863 | 3/1976 | Schuwerk | 350/62 |

*Primary Examiner*—Henry A. Bennett
*Assistant Examiner*—Siddharth Ohri
*Attorney, Agent, or Firm*—Pearne, Gordon, McCoy & Granger

[57] ABSTRACT

A self-powered forced or induced draft water heater is provided including a tank adapted for storing hot water, a sealed combustion chamber, a powered burner, a thermoelectric module, and a through-chamber heat sink having a base portion and a pin portion. The combustion chamber has a common wall with the tank at a lower zone of the tank. The powered natural gas burner has a blower which delivers air to the burner through an inlet duct and forces combustion products out a flue. The thermoelectric module generates operating power for the burner blower. The thermoelectric module has a hot side in thermal communication with a combustion zone of the burner and a cold side attached to the heat sink base portion. The pin portion of the heat sink is conically shaped and extends through an opening in the common wall to the interior of the tank. The base portion of the heat sink is removably attached to the common wall and is provided with an o-ring or other means to seal the wall opening.

24 Claims, 4 Drawing Sheets

Fig.5
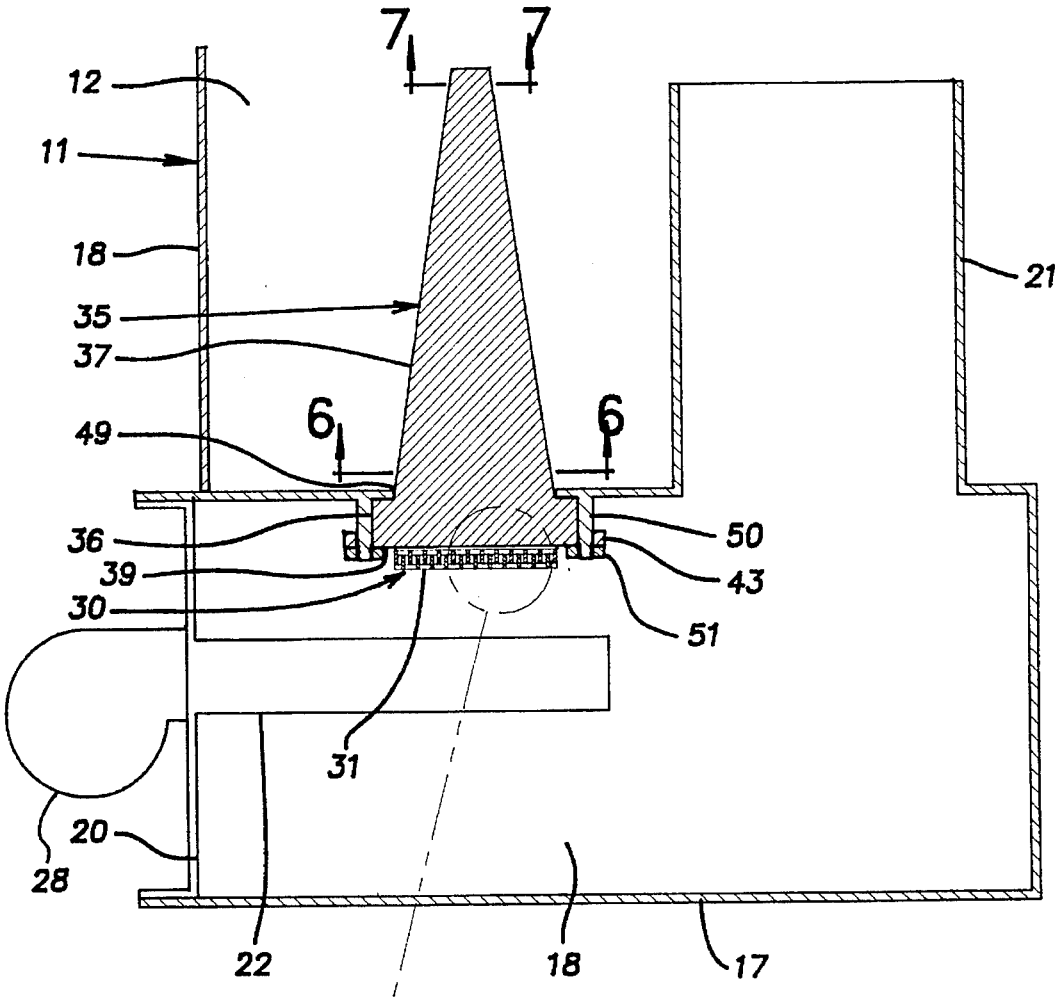
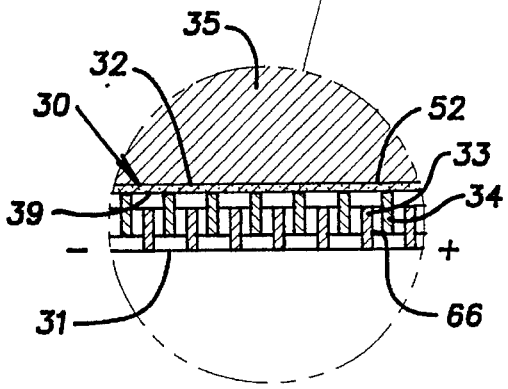
Fig.5A
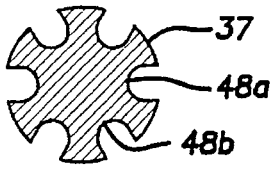
Fig.6
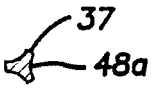
Fig.7

WATER HEATER WITH THERMOELECTRIC MODULE AND THROUGH-CHAMBER HEAT SINK

BACKGROUND OF THE INVENTION

The present invention generally relates to gas fired water heaters, and more specifically, to self powered, either forced or induced draft, gas fired water heaters having a thermoelectric module and a through-chamber heat sink.

A gas fired water heater generally has an insulated tank for storing hot water. Cold water supplied to the tank is heated by a flame produced by a natural gas burner operating at atmospheric pressure. The combustion products produced by the burner are removed by a natural draft chimney. In a typical home, the chimney is shared with a gas furnace.

In the future, however, most gas furnaces may not need a chimney. Powered gas furnaces may be necessary to meet lowering emission standards and increasing efficiency mandates. Powered devices have an electric fan or blower to propel the combustion air through the gas burner and obtain more complete combustion and extract more heat from the combustion products in a heat exchanger. Because the blower provides the draft and the temperature of the combustion products leaving the furnace is relatively low, the furnace can be vented through the wall.

In existing homes, the chimney will become oversized if the water heater is operating alone. An oversized chimney can result in inadequate draft and condensation leading to corrosion and structural damage. Thus, a chimney liner could be required, or the chimney could be required to be blocked off and the gas water heater replaced with a powered unit that can be vented through the wall. Additionally, more stringent emission standards and increasing efficiency mandates may necessitate powered water heaters. Powered water heaters, therefore, may become desirable because of the absence of a chimney or the presence of a standard or mandate.

Gas water heaters are desirable because of low operating cost and a short recovery rate of initial and installed costs. The need for an electrician to hard wire powered gas water heaters, however, would significantly increase the installation cost of gas water heaters. A self-powered gas water heater could eliminate the need for hard wiring and keep the low operating cost of a gas water heater available for the homeowner.

Therefore, it is an objective of the present invention to provide a powered water heater that does not require hard wiring for electrical power. It is also an objective of the present invention to provide a powered water heater having low initial and installed costs. It is a further objective of the present invention to provide a powered water heater having a thermoelectric module under conditions sufficient to provide all operating power. It is also the objective of this invention to provide a self-powered water heater that is easily repaired or maintained.

SUMMARY OF THE INVENTION

The present invention provides a self-powered gas water heater, having a thermoelectric generator, that avoids the high installation cost associated with hard wiring utility power to a powered gas fired water heater. Limitations of prior art devices are overcome by providing a thermoelectric module in a combustion chamber and in thermal communication with a sealed through-chamber heat sink.

According to the present invention, a tank is provided for storing hot water in an interior space and includes a wall defining a combustion chamber at a lower zone thereof. The wall defines an opening connecting the interior space and the combustion chamber. A heat sink extends through the opening into the interior space of the tank. A means for sealing the opening is also provided to prevent the hot water in the interior space from entering the combustion chamber. A powered natural gas burner is provided and includes a combustion zone in the combustion chamber. A thermoelectric module is contained within the combustion chamber for generating operating power for the burner and has a hot side and a cold side. The hot side of the thermoelectric module is in thermal communication with the combustion zone of the burner, and the cold side is in thermal communication with the heat sink.

A preferred embodiment includes a means for removably mounting the thermoelectric module in the combustion chamber to provide ease of access and maintenance. Additionally, by thermally communicating the cold side of the thermoelectric module with the sealed through-chamber heat sink and locating the hot side of the thermoelectric module adjacent the combustion zone of the burner, a maximum temperature differential between the hot side and cold side is obtained. With the through-chamber heat sink and thermoelectric module mounted in this way, commercially available low cost thermoelectric modules can provide adequate power to operate the powered burner. Moreover, by requiring only a single opening in the wall separating the interior space of the water heater and the combustion chamber, tank production costs and potential leaks are minimized.

BRIEF DESCRIPTION OF THE DRAWINGS

The present invention will hereafter be described with reference to the drawing figures, wherein:

FIG. 5 is a schematic elevational view, in cross section, of a water heater in the area of the combustion chamber;

FIG. 5A is an elevational view, in cross section, of the thermoelectric module;

FIG. 6 is a cross sectional view of the heat sink taken along line 6—6 of FIG. 5;

FIG. 7 is a cross sectional view of the heat sink taken along line 7—7 of FIG. 5;

DETAILED DESCRIPTION OF THE PREFERRED EMBODIMENTS

Figure 1:
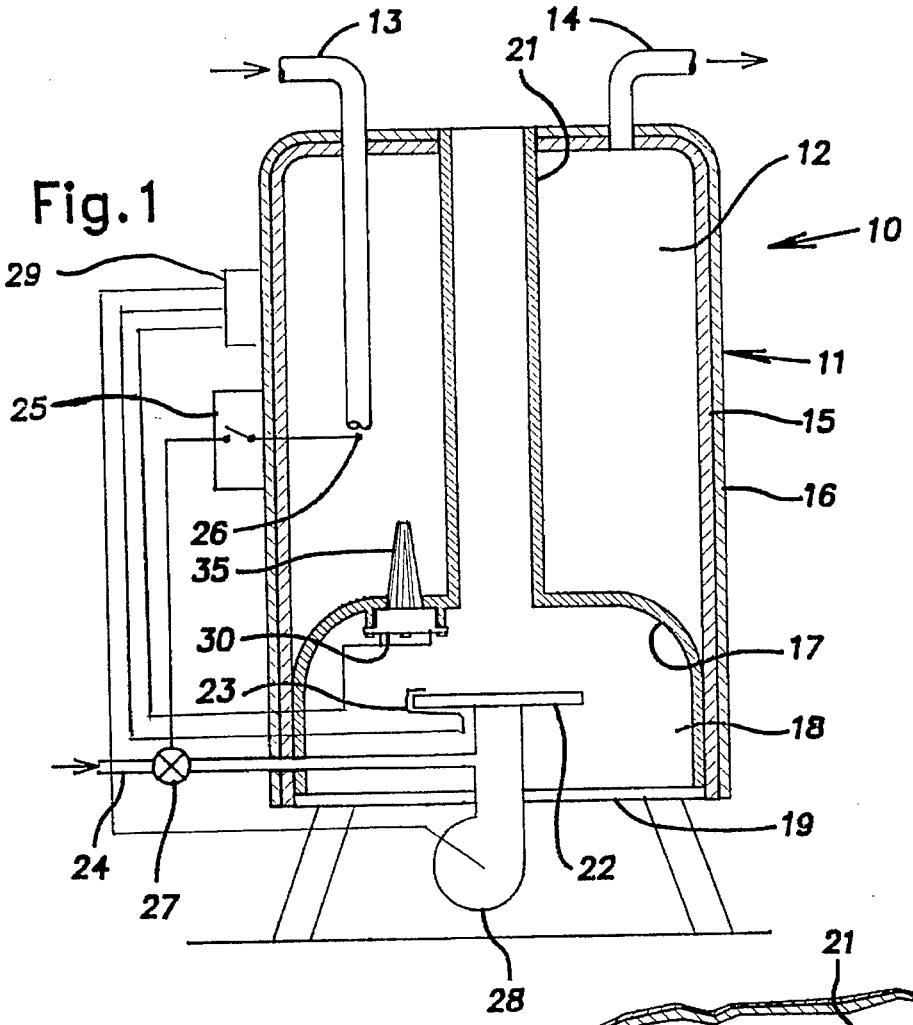
FIG. 1 is a somewhat schematic elevational view, in cross section, of a powered water heater according to the invention.
Figure 2:
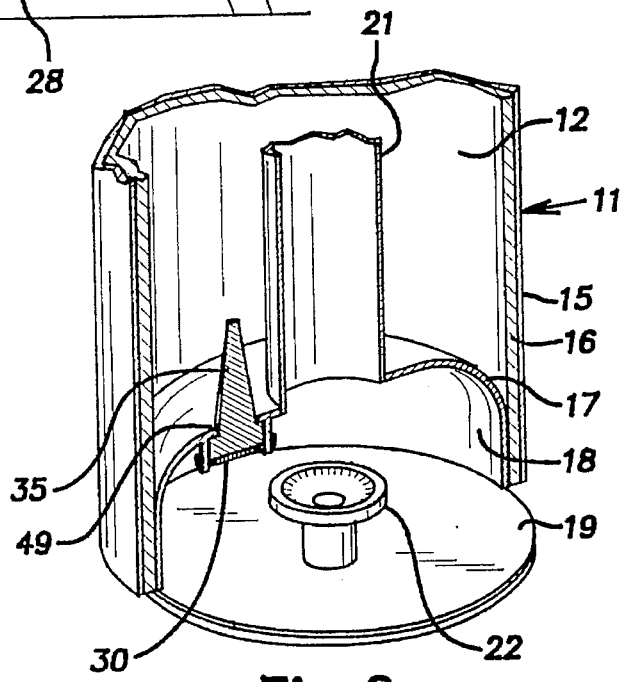
FIG. 2 is a fragmentary perspective view, in partial cross section, of the water heater of FIG. 1 in the area of the combustion chamber.

A self powered water heater 10 according to the invention is shown in FIG. 1. The water heater has a tank 11 adapted for storing hot water in an interior space 12 as is conventional. The tank 11 is provided with a cold water inlet 13 and a hot water outlet 14. An exterior of a steel tank wall 15 is covered with insulation 16 on an outside surface to reduce heat transfer from the hot water to a surrounding air space. The tank 11 typically has a sheet metal outer panel (not shown) covering the insulation 16. In a generally conventional manner, a common steel wall 17 is common to both the tank and a sealed combustion chamber 18 in that it forms a portion of both. Preferably the combustion chamber 18 and the common wall 17 are situated at the bottom of the tank 11 or a lower zone thereof. The combustion chamber 18 can typically be accessed through a bottom panel 19. Alternatively, the common wall 17 can extend from the exterior wall 15 to form the combustion chamber 18 in a lower portion or zone of the tank 11 as shown in FIG. 5. In this alternative configuration, the combustion chamber 18 is accessed from a removable side panel 20. As shown in FIG. 1, a steel flue 21 extends upwardly from the combustion chamber 18 through the tank walls 15, 17. The flue 21 is vented to the exterior of the building (not shown).

Associated with the combustion chamber 18 is a powered pre-mix burner 22 having a combustion zone within the combustion chamber 18. The preferred burner 22 is rated at 40,000 btu/hour and is designed to operate with excess air to yield low NOx levels. An ignition unit 23 is incorporated with the burner 22 to provide a means for igniting a flame in the combustion zone. It will be understood that, alternatively, a continuous pilot can be used. A natural gas supply line 24 supplies fuel to the burner 22. A thermostat 25, having a thermocouple 26, in conjunction with a microprocessor control circuit (not shown), controls a regulator 27 in the natural gas supply line 24 and an electric blower 28 of the burner 22 which delivers air drawn from outside the residence or otherwise occupied building. The electric blower 28 preferably is a compact high efficiency blower having a low power brushless D.C. motor operating at approximately 4.0 volts.

For start-up power, a rechargeable battery 29 is preferably provided to supply power to both the electric blower 28 and ignition unit 23. As shown in FIG. 1, the battery 29 is electrically coupled to the blower 28 and the ignition unit 23. A thermoelectric generator or module 30, hereinafter described in more detail, is also electrically coupled to the battery 29 in a charging circuit (not shown) to recharge the battery 29. The preferred battery 29 delivers approximately 4.0 volts and is preferably of a lead acid gel cell type. Other types of batteries, such as nickel cadmium, can be used but may require more complex recharging circuits.

The thermoelectric module 30 is contained within the combustion chamber 18 for generating operating power for the electric blower 28 and recharging the battery 29. As shown in FIG. 1, the thermoelectric module 30 is electrically coupled to the blower 28 and the battery 29. The thermoelectric module 30 is based on the Seebeck effect. As seen in FIG. 5A, in a first material type 33, a voltage difference between a hot junction 31 and a cold junction 32 results from the flow of negatively charged electrons (hot junction positive, cold junction negative). In a second material type 34, a voltage difference results from the flow of positively charged voids vacated by electrons (cold junction positive, hot junction negative). The two thermoelectric material types 33, 34 make it possible to connect the hot and cold junctions 31, 32 electrically in series and thermally in parallel. The thermoelectric materials 33, 34 are separated by insulators 66. Such a thermoelectric module 30 produces power at an efficiency in the order of four to nine percent.

The thermoelectric module 30 of the preferred embodiment measures approximately 2 inches long, 2 inches wide, and ¼ inch thick and has a generally planar hot side 31 and a generally planar cold side 32. With a hot side temperature of approximately 500 degree Fahrenheit and an approximately 320 degree Fahrenheit temperature differential between the hot and cold sides 32, 33, the thermoelectric module 30 generates approximately 7 watts. The thermoelectric module 30 of the preferred embodiment is a TELAN model available from Teledyne Brown Engineering, Hunt Valley, Md.

Figure 4:
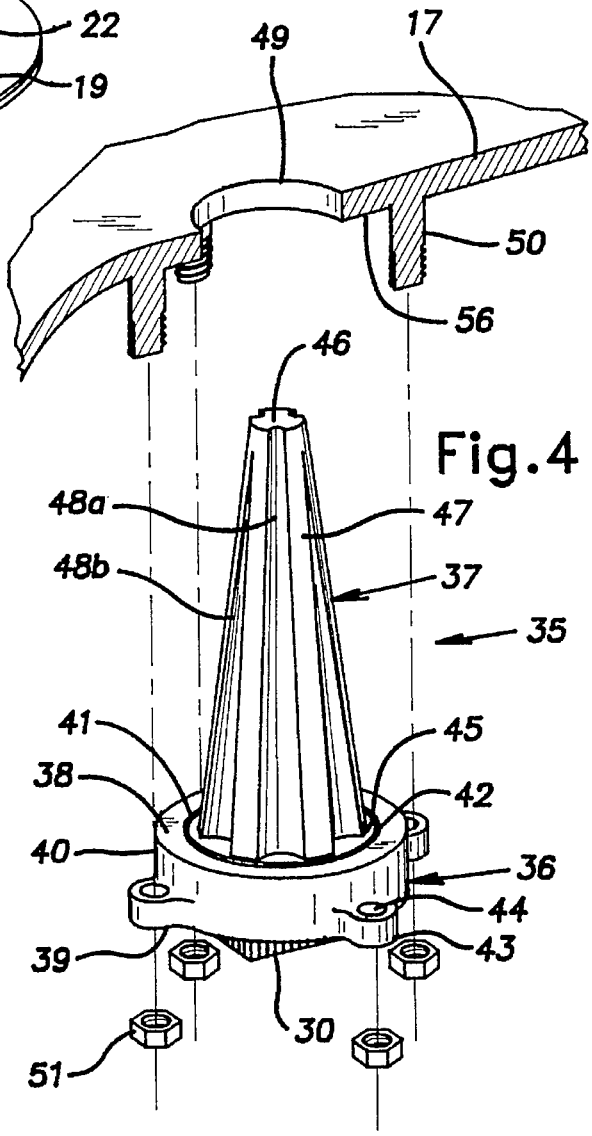
FIG. 4 is a partial exploded view, in partial cross section, in the area of the heat sink.

The thermoelectric module 30 is attached to a heat sink 35 which extends from the combustion chamber 18 through the common wall 17 to the water stored in the tank interior space 12. As best seen in FIG. 4, the heat sink 35 has a base portion 36 and an extended pin portion 37. Preferably, the heat sink 35 is of unitary or one piece construction. The base portion 36 is preferably generally cylindrically-shaped and forms an upper surface 38, a lower surface 39, and an outer surface 40. The pin portion 37 axially extends from the center of the annularly-shaped and generally planar upper surface 38. An annular groove 41 is formed in the upper surface 38 within which is mounted a gasket or o-ring 42. The lower surface 39 provides a planar mounting surface preferably for the entire surface area of the thermoelectric module cold side 32 and is preferably flat within 0.002 inches. Preferably, four circumferentially spaced mounting elements 43 outwardly extend from the outer surface 40 of the base portion 36. The mounting elements 43 each form an axially extending opening 44 therein.

The extended pin portion 37 has a length substantially greater in dimension than its transverse section and preferably is generally conically-shaped. The pin portion 37 of the preferred embodiment has a diameter of approximately 2.25 inches at a bottom edge 45 at the base portion upper surface 38 and tapers to a top surface 46 having a diameter of approximately 0.5 inches. Extending axially and radially inwardly from an outer surface 47 of the pin portion 37 are alternatingly three full grooves **48*a* and three partial grooves 48*b*, all forming an arcuate inner surface. The generally axially extending grooves form radially outwardly extending fins along the axial length of the pin portion 37. The full grooves 48*a* have a radial depth of approximately 0.50 inches at the bottom edge 45 and gradually taper to a radial depth of approximately 0.13 at the top surface 46 as best seen in FIGS. 6 and 7. The partial grooves 48*b* have a radial depth of approximately 0.5 inches at the bottom edge 45 and taper to blend into the outer surface 47 at distance approximately 0.38 inches below the top surface 46. The grooves 48*a*, 48*b* have a circumferential width of approximately 0.50 inches at the bottom edge 45**.

It will be noted that other quantities, geometries, or orientations of grooves or protrusions can be used to increase the outer surface area of the pin portion 37. It will also be noted that the pin portion 37 can have other geometries such as a cylindrical-shape.

The preferred material for the heat sink 35 is aluminum. However, other materials having a high thermal conductivity, such as copper, can be used. The aluminum heat sink 35 is anodized and may be further coated with known protective materials to prevent corrosion.

Figure 3:
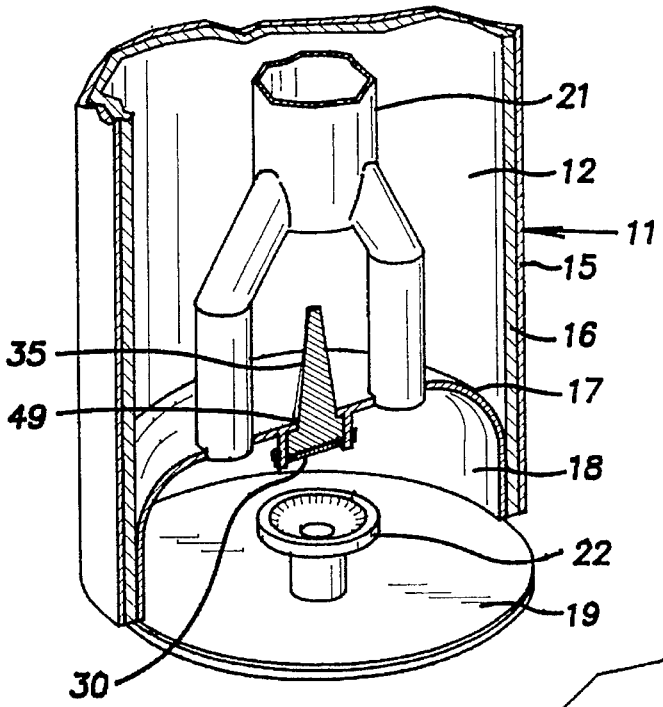
FIG. 3 is a fragmentary perspective view, in partial cross section, similar to FIG. 2 but with a center mounted heat sink.

As seen in FIGS. 1–5, a generally planar portion of the common wall 17 defines a circularly-shaped opening 49 which connects the combustion chamber 18 to the interior space 12 of the tank 11. The opening 49 is sized to have a diameter large enough to allow the heat sink pin portion 37 to extend therethrough, but smaller than the diameter of the gasket or o-ring 42. The opening 49 can be offset from the center of the exterior wall 15 (FIG. 2) or alternatively at the center of the exterior wall 15 (FIG. 3). If the opening 49 is located at the center location, the exhaust flue 21 can be branched to locations adjacent the opening 49 as shown in FIG. 3. Extending downwardly from the interior wall 17 adjacent the opening 49 and into the combustion chamber 18 are four threaded mounting studs 50. The mounting studs 50 are positioned and dimensioned to cooperate with the heat sink mounting elements 43.

The heat sink 35 is installed by upwardly moving the heat sink pin portion 37 in the combustion chamber 18 toward the wall opening 49 while orienting the heat sink base portion 36 such that the mounting studs 50 extend through the mounting element openings 44. The movement is continued until the pin portion 37 extends through the wall opening 49 and the upper surface 38 of the base portion 36 contacts the wall 17. Standard nuts 51 adapted for cooperating with the mounting studs 50 are rotated onto the mounting studs 50 until the heat sink 35 is retained against the wall 17. With the heat sink 35 mounted in this position, the o-ring 42 on the base portion upper surface 38 is in sealable contact with the wall 17 to prevent the water in the tank interior space 12 from entering the combustion chamber 18.

As best seen in FIGS. 5 and 5A, the cold side 32 of the thermoelectric module 30 is in thermal contact with the bottom surface 39 of the heat sink 35. In the preferred embodiment, the thermoelectric module 30 is attached to the heat sink 35 by a layer of adhesive 52 between the heat sink bottom surface 39 and the thermoelectric module cold side 32. Attached in this location the thermoelectric module hot side 31 is horizontally positioned above the burner 22 and within the combustion zone. This location maximizes the temperature at the thermoelectric module hot side 31.

In order to maximize the temperature difference between the thermoelectric module hot side 31 and cold side 32, heat must be removed from the cold side 32. In order to effectively transfer heat from the thermoelectric module cold side 32 at least three thermal resistances must be minimized. These are, first, the interfacial resistance to thermal conduction between the thermoelectric module cold side 32 and the heat sink base portion lower surface 39, second, the resistance to thermal conduction through the heat sink 35, third, the resistance to thermal convection from the heat sink 35 to the water in the tank interior space 12.

The interfacial resistance to thermal conduction is minimized by maximizing contact between the heat sink bottom surface 39 and the thermoelectric module cold side 32. The heat sink bottom surface 39 is sized to substantially match the thermoelectric module cold side 32 so that the heat sink bottom surface 39 generally avoids receiving any significant heat other than through the thermoelectric module 30. In the preferred embodiment, the thermoelectric module 30 is attached to the heat sink 35 by the layer of adhesive 52 which fills any gaps between the surfaces. By using a thin layer of thermally conductive adhesive, the resistance to thermal conduction through the layer of adhesive 52 is minimized. The thickness of the layer should be minimized but must prevent electrical contact between the heat sink 35 and thermoelectric module 30 to prevent electrical shorts.

The adhesive 52 must have generally electrically insulative and thermally conductive properties and be able to withstand the high temperatures generated by the burner 22 at the thermoelectric module cold side 32. Many commercially available adhesives meet these requirements such as DURALCO 132 by Cotronics Corporation, Brooklyn, N.Y. DURALCO 132 has a maximum temperature limit of 500 degrees Fahrenheit, a volume resistance of 106, and a thermal conductivity of 60 BTU-IN/HR-DEG F-SQ FT The resistance to thermal conduction through the heat sink 35 is reduced by fabricating the heat sink 35 from a highly thermally conductive material. In the preferred embodiment, the as mentioned heat sink 35 is made of aluminum, but other materials such as copper can be utilized. Additionally, the cross sectional area of the heat sink 35 may be maximized at the lower surface 39 and gradually reduced to a minimum cross sectional area at the top surface 46 or it may have other geometries.

The resistance to thermal convection from the heat sink 35 is reduced by increasing the surface area of the heat sink pin portion 37. The increased surface area provides increased contact area with the water to increase the heat transfer between the heat sink 35 and water in the tank interior space 12.

The location of the thermoelectric module 30 within the combustion chamber 18 is ideal for ease of access and maintenance. Upon removing the burner 22, the thermoelectric module 30 can be easily reached in the combustion chamber 18. Means for removably mounting the thermoelectric module 30 in the combustion chamber 18 is also preferably provided. In the preferred embodiment, the thermoelectric module 30 is fixed to the heat sink 35 which as described includes means for its removable mounting in the combustion chamber 18. Therefore, the heat sink 35 can be removed from the combustion chamber 18, along with the attached thermoelectric module 30 for repair or replacement. It will be noted that the water in the tank interior space 12 must first be removed before removing the heat sink 35. A wrench (not shown) is extended into the combustion chamber 18 and positioned onto the nuts 51 and rotated to unthread and remove the nuts 51 from the threaded mounting studs 50. The heat sink 35 can then be lowered into the combustion chamber 35. Once the heat sink 35 is lowered, the heat sink 35 and attached thermoelectric module 30 can be removed from the combustion chamber 18. When desired, the heat sink 35 and thermoelectric module 30 can be reinstalled by reversing the above described steps.

It will be noted that other means for removably mounting the thermoelectric module 30 known to those skilled in the art are possible. For example, the heat sink 35 can provide clamping members that removably clamp the thermoelectric module 30 to the heat sink 35. Any gaps between the clamped components could be filled with a layer of commercially available thermally conductive grease.

During operation, the thermostat 25 is adjusted to a desired temperature. If the thermocouple 26 senses a water temperature lower than the desired water temperature then the control unit activates the blower 28 and natural gas line regulator 27 to deliver the air and fuel to the burner 22. The fuel and air are mixed and the ignition unit 23 is activated to ignite the fuel air mixture to produce a flame in the combustion zone of the burner 22. During this sequence of events the battery 29 is supplying power to the blower 28 and ignition unit 23. Heat produced by the flame is substantially transferred through the combustion chamber 18 and the common wall 17 to the water in the tank interior space 12. The combustion products produced by the flame are vented out of the sealed combustion chamber 18 through the flue 21, where they also transfer heat to the water in the tank, and out of the building.

The temperature of the thermoelectric generator hot side 31 which is adjacent the flame produced by the burner 22 is raised to approximately 500 degree Fahrenheit or greater. A portion of the heat is conducted to the thermoelectric module cold side 32. Because the thermoelectric module cold side 32 is thermally contacting the heat sink 35, the heat is transferred to the heat sink base portion 36. Because the heat sink base portion 36 is at a temperature higher than the pin portion 37 which is in contact with the water, the heat conducts from the base portion 36 to the pin portion 37. Once conducted to the pin portion 37, the heat transfers to the lower temperature water in the tank interior space 12. Thus this configuration provides good heat transfer to provide a low temperature at the thermoelectric module cold side 32.

Thermoelectric module 30 begins to generate electricity as the hot side 31 is heated up and a temperature difference is created between the hot side 31 and cold side 32. The power generated by the thermoelectric module 30 is used to operate the blower 28 as the burner 22 continues to produce a combustion flame to heat the water. The power generated by the thermoelectric module 30 also recharges the battery 29 for future start-up of the blower 28. When the temperature of the water in the tank reaches the desired temperature, the control unit stops the supply of air and fuel to the burner 22 and the flame is extinguished. If the temperature of the water in the tank again drops below the desired temperature, because of cold water being added to the tank or heat loss through the tank 11, the above described sequence of events is repeated. Operating in this manner the above described water heater is capable of recovery efficiencies of up to 85 percent (34,000 BTU/HR with the 40,000 BTU/HR burner).

Figure 8:
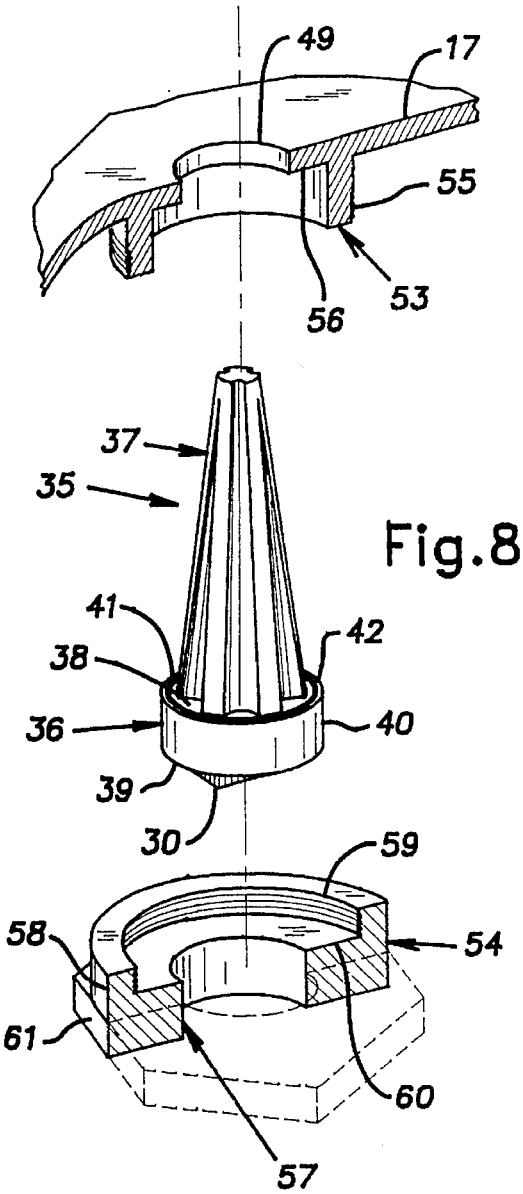
FIG. 8 is a partial exploded view, in partial cross section, in the area of the heat sink of a second embodiment of the invention.

A second embodiment of the invention is shown in FIG. 8. Extending downwardly from the interior wall 17 into the combustion chamber 18 and encircling the opening 49 is a collar 53. The collar 53 is tubularly-shaped and has external threads 55. The interior diameter of the collar 53 is sized to cooperate with the base portion outer surface 40 of the heat sink 35. The collar 53 thus encircles a sealing surface portion 56 of the wall 17 which is engaged by the heat sink o-ring 42. A nut-like retainer 54 is generally tubularly shaped having an inner surface 57 and an outer surface 58. The inner surface 57 has an upper portion defining internal threads 59 complimentary with the flange external threads 55 and a lower portion having a reduced diameter forming a step 60. The lower portion diameter of the retainer inner surface 57 is sized to be smaller than the base portion 36 diameter of the heat sink 35 and larger than the thermoelectric module 30. The retainer outer surface 58 defines a hexagonally-shaped wrenching surface 61.

The heat sink 35 is installed by upwardly moving the heat sink pin portion 37 in the combustion chamber 18 toward the wall opening 49. The movement is continued until the pin portion 37 extends through the wall opening 49 and the o-ring 42 of the heat sink base portion 36 contacts the sealing surface portion 56 of the wall 17. The retainer 54 is threaded onto the flange 53 and rotated with a wrench on the wrenching surface 61 until retainer step 60 contacts the base portion lower surface 39 and retains the base portion upper surface 38 against the wall 17. Mounted in this position, the o-ring 42 of the base portion is in sealable contact with the wall 17 to prevent the water in the tank interior space 12 from entering the combustion chamber 18.

Figure 9:
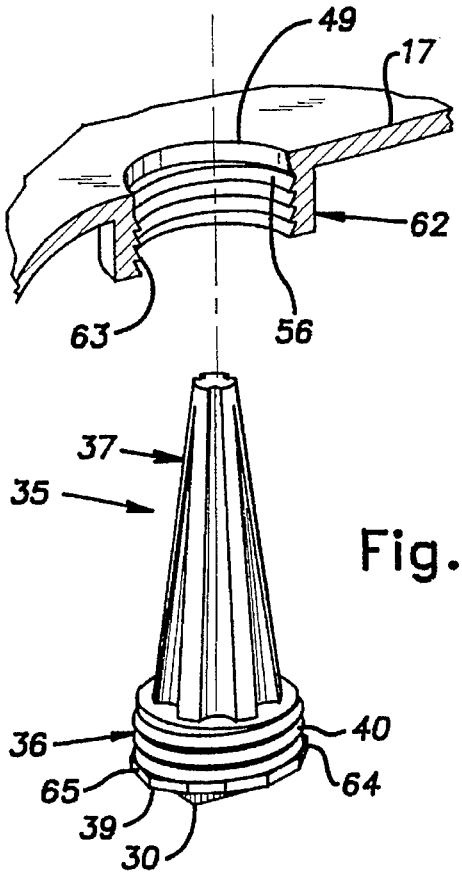
FIG. 9 is a partial exploded view, in partial cross section, in the area of the heat sink of a third embodiment of the invention.

A third embodiment of the invention is shown in FIG. 9. Extending downwardly from the interior wall 17 into the combustion chamber 18 and encircling the opening 49 is a collar 62. The collar 62 is tubularly-shaped and has internal threads 63 for substantially the full axial length of the collar 62. The interior diameter of the collar 62 is sized to cooperate with threads 64 formed on the outer surface 40 of the heat sink base portion 36. The cooperating threads 63, 64 of the collar 62 and heat sink 35 are standard taper pipe threads. The base portion outer surface 40 of the heat sink 35 defines a hexagonally-shaped wrenching surface 65 at a lower end.

The heat sink 35 is installed by upwardly moving the heat sink pin portion 37 in the combustion chamber 18 toward the wall opening 49. The movement is continued until the heat sink threads 64 engage the flange threads 63. The heat sink 35 is then rotated with a wrench on the wrenching surface 65 until it is fully threaded into the collar 62. By using standard taper pipe threads the connection is sealed to prevent the water in the tank interior space 12 from entering the combustion chamber 18.

Although particular embodiments of the water heater 10 have been described in detail, it will be understood that the invention is not limited correspondingly in scope, but includes all changes and modifications coming within the spirit and terms of the claims appended hereto.

What is claimed:

1. A water heater comprising a tank adapted for storing hot water in an interior space and including a wall defining a portion of a combustion chamber at a lower zone thereof, said wall defining an opening connecting said tank interior space and said combustion chamber, a heat sink for conducting heat through said opening into said interior space of said tank, means for sealing said opening to prevent said hot water in said interior space from entering said combustion chamber, a powered burner associated with said combustion chamber and having a combustion zone, and a thermoelectric module in thermal communication with said combustion chamber for generating operating power for said burner, said thermoelectric module having a cold side in thermal communication with said heat sink and a hot side in thermal communication with the combustion zone of said burner.

2. The water heater according to claim 1, comprising a pilotless ignition module for igniting said burner and a battery for powering said ignition module, said thermoelectric module being electrically coupled for charging said battery.

3. The water heater according to claim 1, wherein said heat sink has a base portion for mounting said heat sink to said tank wall and an elongated pin portion for extending into said tank interior space.

4. The water heater according to claim 3, wherein said heat sink pin portion has a length substantially greater in dimension than its transverse section.

5. The water heater according to claim 3, wherein said heat sink pin portion is generally conically-shaped.

6. The water heater according to claim 5, wherein said heat sink pin portion has radially outwardly extending fins formed by generally axially extending grooves.

7. The water heater according to claim 1, further comprising means for removably mounting said thermoelectric module in said combustion chamber.

8. The water heater according to claim 3, comprising means for removably mounting said heat sink, said heat sink base portion having a substantially planar surface with said thermoelectric module cold side fixed thereto.

9. The water heater according to claim 8, wherein said thermoelectric module cold side is fixed to said heat sink by thermally-conductive adhesive.

10. The water heater according to claim 8, said heat sink mounting means comprising a plurality of threaded studs extending from said wall adjacent said opening and into said combustion chamber, a plurality of cooperating mounting elements extending from said heat sink base portion and defining openings through which said studs extend, and threaded nuts cooperating with said studs for retaining said mounting elements.

11. The water heater according to claim 8, said heat sink mounting means comprising a collar extending from said wall and encircling said wall opening, said collar having an internal surface defining threads thereon, said heat sink base portion having an external surface defining threads cooperating with said collar threads and a wrenching surface for installing and removing said heat sink.

12. The water heater according to claim 11, said sealing means comprising coordinating standard taper pipe threads formed on said collar internal surface and said base portion external surface.

13. The water heater according to claim 8, said heat sink mounting means comprising a collar extending from said wall at a distance from and encircling said opening, said collar having an external surface defining threads thereon and an internal surface adapted to cooperate with said heat sink base portion, and a retaining member having an internal and external surface, said retaining member internal surface having threads cooperating with said collar threads and a step engaging said heat sink base portion to retain said heat sink base portion in said collar and against said wall, said retaining member external surface having a wrenching surface for installing and removing said retaining member.

14. The water heater according to claim 13, said sealing means comprising a gasket encircling said wall opening and between said wall and said heat sink base portion.

15. The water heater according to claim 3, said sealing means comprising a gasket encircling said wall opening and between said tank wall and said heat sink base portion.

16. A water heater comprising a tank adapted for storing hot water in an interior space and including a wall defining a portion of a combustion chamber at a lower zone thereof, a powered natural gas burner associated with said combustion chamber and having a combustion zone, said wall defining an opening, a heat sink having a pin portion extending through said opening into said interior space of said tank and a base portion removably mounted to said wall and having a substantially planar surface, a gasket between said wall and said base portion for sealing said opening to prevent said hot water in said tank interior space from entering said combustion chamber, a thermoelectric module contained within said combustion chamber for generating operating power for said burner, said thermoelectric module having a cold side fixed to said base portion planar surface and a hot side in thermal communication with the combustion zone of said burner.

17. A thermoelectric module for supplying operating power to a powered burner in a tank-type water heater, the module being mounted on a heat sink, said heat sink comprising a base portion having a substantially planar end surface, and an elongated pin portion extending from base portion and adapted to be disposed into the water contained in the tank.

18. The thermoelectric module according to claim 17, wherein said pin portion is generally conically shaped and has radially outwardly extending fins formed by generally axially extending grooves.

19. The thermoelectric module according to claim 17, comprising means for mechanically mounting the heat sink.

20. The thermoelectric module according to claim 19, comprising means for sealing a hole in the tank of the water heater into which the pin portion extends.

21. A water heater comprising a tank having a wall construction primarily of steel for storing a quantity of heated water and including an inlet and an outlet, a combustion area in heat exchange relation with a portion of the steel wall, a hole in the steel wall portion, a thermoelectric module adjacent the hole, the thermoelectric module having a cold side arranged to conduct heat through the hole into water stored in the tank and a hot side exposed to combustion in the combustion area to be heated thereby, and a circuit for conducting electrical energy generated by the thermoelectric module during combustion to power an air blower arranged to supply combustion air to the combustion area.

22. A water heater as set forth in claim 21, wherein the thermoelectric module cold side is on a material having a high heat conducting capacity substantially greater than steel.

23. A water heater as set forth in claim 22, wherein the high heat conducting material projects substantially into the interior of the tank.

24. A water heater comprising a tank having a wall construction primarily of steel for storing a quantity of heated water and including an inlet and an outlet, a combustion area in heat exchange relation with a portion of the steel wall, a thermoelectric module having a cold side arranged to conduct heat into water stored in the tank and a hot side exposed to combustion in the combustion area to be heated thereby, means to enhance heat conduction from the cold side through the wall of the tank, and a circuit for conducting electrical energy generated by the thermoelectric module during combustion to power an air blower arranged to supply combustion air to the combustion area.

* * * * *